US006233915B1

(12) United States Patent
Hadder et al.

(10) Patent No.: US 6,233,915 B1
(45) Date of Patent: May 22, 2001

(54) INJECTION TUBE FOR CONNECTING A COLD PLENUM TO A HOT CHAMBER

(75) Inventors: James L. Hadder, Scottsdale; Kyle A. Lawrence, Chandler, both of AZ (US)

(73) Assignee: Allied Signal, Inc., Morris Township, NJ (US)

( * ) Notice: Subject to any disclaimer, the term of this patent is extended or adjusted under 35 U.S.C. 154(b) by 0 days.

(21) Appl. No.: 09/046,480

(22) Filed: Mar. 23, 1998

Related U.S. Application Data

(60) Provisional application No. 60/042,019, filed on Apr. 1, 1997.

(51) Int. Cl.[7] ..... F02C 7/20

(52) U.S. Cl. ..... 60/39.06; 60/39.32; 285/261; 285/263

(58) Field of Search ..... 60/39.06, 39.32, 60/737; 285/261, 263, 305, 187, 145.3

(56) References Cited

U.S. PATENT DOCUMENTS

| | | | | |
|---|---|---|---|---|
| 1,425,635 | | 8/1922 | Dod . | |
| 2,437,385 | | 3/1948 | Halford . | |
| 2,516,743 | | 7/1950 | Allin . | |
| 2,592,372 | | 4/1952 | Altorfer . | |
| 4,377,371 | | 3/1983 | Wisander et al. . | |
| 4,430,360 | | 2/1984 | Bill et al. . | |
| 4,553,775 | * | 11/1985 | Halling | 285/55 |
| 4,764,089 | | 8/1988 | Strangman . | |
| 4,772,033 | | 9/1988 | Nash . | |
| 4,884,820 | | 12/1989 | Jackson et al. . | |
| 4,906,031 | * | 3/1990 | Vyse | 285/318 |
| 4,914,794 | | 4/1990 | Stangman . | |
| 5,116,158 | | 5/1992 | Carruthers et al. . | |
| 5,216,808 | | 6/1993 | Martus et al. . | |
| 5,265,412 | | 11/1993 | Bagepalli et al. . | |
| 5,279,031 | | 1/1994 | Carruithers et al. . | |
| 5,352,540 | | 10/1994 | Schienle et al. . | |
| 5,477,671 | * | 12/1995 | Mowill | 60/39.23 |

FOREIGN PATENT DOCUMENTS

| | | |
|---|---|---|
| 254137 | 12/1948 | (CH) . |
| 2199844 | 4/1974 | (FR) . |
| 638283 | 6/1950 | (GB) . |
| 790248 | 2/1958 | (GB) . |
| 2 063 189 | 6/1981 | (GB) . |
| WO 92/06333 | 4/1992 | (WO) . |

* cited by examiner

*Primary Examiner*—Charles G. Freay
(74) *Attorney, Agent, or Firm*—Robert Desmond, Esq.

(57) ABSTRACT

An injection tube for connecting a plenum to a combustion chamber includes a first mouth having a longitudinal axis and adapted for insertion into a cold plenum port or other component and a second mouth having a longitudinal axis and adapted for insertion into a hot chamber port or other component. To accommodate flexural, axial and torsional forces caused by differential thermal expansion between the two components, the mouths of the tube are configured to have multiple degrees of freedom within each corresponding port while maintaining port-mouth seal integrity. In an illustrative embodiment, the first mouth outer surface shape allows free slip of the first mouth parallel to the first mouth longitudinal axis, as well as rotation of the first mouth about both the first mouth longitudinal axis and a first mouth outer surface transverse axis. Mounted on the outer surface of the tube is a rocker arm adapted to engage a pivot mounted on the chamber outer surface or to engage the chamber outer surface itself. The rocker engagement allows rotation of the second mouth about a second mouth transverse axis while constraining axial movement of the tube, thereby preventing the second mouth from disengaging the chamber port.

19 Claims, 3 Drawing Sheets

INJECTION TUBE FOR CONNECTING A COLD PLENUM TO A HOT CHAMBER

This application claims the benefit of U.S. Provisional application Ser. No. 60/042,019 filed Apr. 1, 1997.

FIELD OF THE INVENTION

The present invention relates to turbine engine componentry, specifically to a means for conveying a working fluid from one component to another.

BACKGROUND OF THE INVENTION

In engines of varying types, there is frequently the need for a conduit by which a gas or other fluid is conveyed from one component to another. In gas turbine engines, for example, the air exiting a compressor is collected in a plenum and mixed with fuel. This air-fuel mixture then flows through a venturi or other conduit to a combustion chamber where the mixture is ignited to form a hot gas. Because most engineering materials expand when heated, the hot gas production causes the combustion chamber to enlarge. The plenum, which is not exposed to the hot combustion gases, does not experience thermally-related growth to the extent experienced by the combustion chamber. In gas turbine engine modules such as that disclosed in U.S. Pat. No. 5,572,862 to Mowill, ("the '862 patent") the ideal injector tube-chamber configuration is such that the tube enters the chamber in a substantially tangential manner. In addition, the tube must be substantially fixed at both the plenum and combustion chamber ends in order to effectively serve as a conduit. In such an arrangement wherein the thermal growth of the combustion chamber is substantially greater than that of the plenum, the tube will likely experience significant axial and flexural stresses and corresponding strains. In attempting to prevent tube strain induced pressure against the chamber from puncturing the chamber lining, one could theoretically provide clearance at the interfaces between the tube and chamber and the tube and plenum. However, such clearances would necessarily result in air leakage, thereby reducing the efficiency of the engine. Accordingly, what is needed is a conduit connecting one component to another component that is designed to accommodate a substantial disparity in thermal growth between those two components while simultaneously maintaining interface seal integrity.

SUMMARY OF THE INVENTION

According to the principles of the present invention, an injection tube or similar conduit includes a first mouth adapted for insertion into a plenum port or other component and a second mouth adapted for insertion into a hot chamber port or other component. To accommodate flexural, axial and torsional forces caused by the differential thermal expansion between the two components, the mouths of the tube are configured to have multiple degrees of freedom within each corresponding port while maintaining port-mouth seal integrity.

In one embodiment of the invention, the first mouth, the entry plane of which may or may not be vertically disposed, includes a fastening element such as an outer surface raised and rounded about the entire perimeter of the mouth and adapted to fit within a cylindrical sleeve incorporated into the plenum port to create what is hereinafter referred to as a spherical slip coupling. The first mouth outer surface shape allows free slip of the first mouth parallel to the first mouth longitudinal axis, as well as rotation of the first mouth about both the first mouth longitudinal axis and a first mouth outer surface transverse axis. The second tube mouth, the exit plane of which may or may not be vertically disposed, is adapted to rotatably engage the chamber port about a transverse axis to create what is hereinafter referred to as an eccentric spherical coupling. Mounted on the outer surface of the tube is a fastening element such as a rocker arm adapted to engage another fastening element such as a pivot mounted on the chamber outer surface or to engage the chamber outer surface itself. The rocker engagement allows rotation of the second mouth about a second mouth transverse axis while constraining axial movement of the tube, thereby preventing disengagement of the second mouth from the chamber port. Alternatively, the second mouth includes an outer surface with a fastening element such as contoured convex and concave portions adapted to rotatably engage a corresponding fastening element such as contoured concave and convex portions incorporated in the chamber port surface. The second mouth outer surface shape allows rotation of the second mouth about a second mouth transverse axis while constraining axial movement of the tube, thereby preventing disengagement of the second mouth from the chamber port.

It is important to note that the utility of the principles of the instant invention is not limited to the engine module disclosed in the '862 patent. The instant invention can be implemented by any combustion-type engine wherein exists differential expansion of one component relative to another.

BRIEF DESCRIPTION OF THE DRAWING

The invention will be better understood from a reading of the following detailed description taken in conjunction with the drawing figures in which like reference designators are used to designate like elements, and in which.

DETAILED DESCRIPTION

Figure 1:
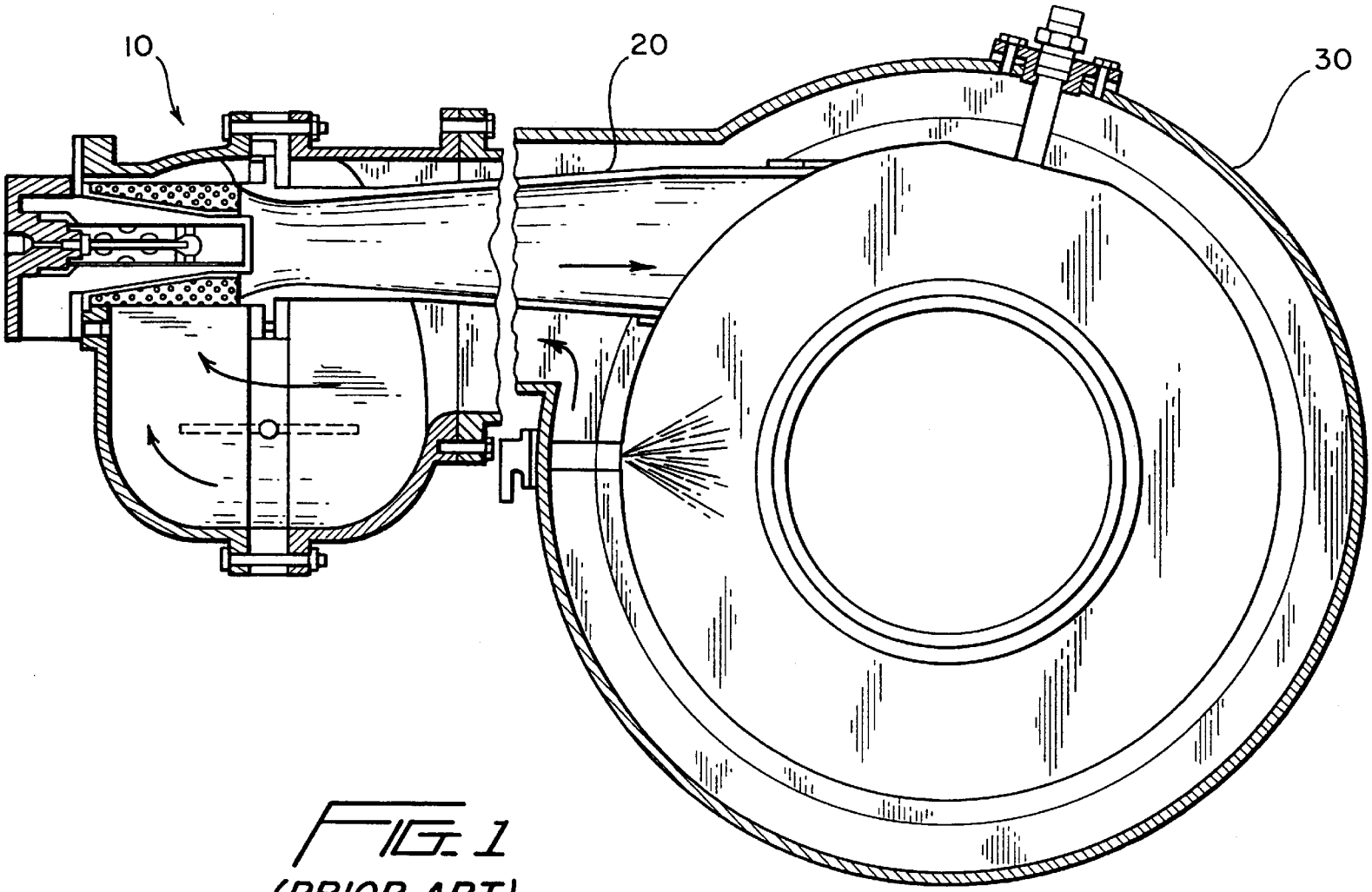
FIG. 1 (PRIOR ART)
FIG. 1 is a side view of an injection tube connecting a plenum to an annular combustion chamber according to the prior art.

The drawing figures are intended to illustrate the general manner of construction and are not to scale. In the description and in the claims the terms left, right, front and back and the like are used for descriptive purposes. However, it is understood that the embodiment of the invention described herein is capable of operation in other orientations than is shown and the terms so used are only for the purpose of describing relative positions and are interchangeable under appropriate circumstances.

FIG. 1 shows, in general, a fluid injection system typical to many combustion-type engine applications and, in particular, an annular combustor system such as is contemplated by the '862 patent. In gas turbine engines implementing such an annular combustor system, the air exiting a compressor is collected in a plenum or other upstream component 10 and mixed with fuel. The resultant air-fuel mixture then flows through an injection tube 20 and into a combustion chamber 30 where the mixture is ignited to form a hot gas. The tube 20 is fixed at each end and enters the chamber 30 in a substantially tangential manner. As discussed more fully in the '862 patent, the purpose of this tangential entry is to create within the chamber 30 a radial swirl of the air-fuel mixture thereby promoting maximal residence time of the mixture within the chamber and, consequently, maximal quantitative mixture combustion and reduced emissions. The production of hot gas within chamber 30 causes chamber 30 to enlarge. The plenum 10, which is not exposed to the hot ignition gases, does not experience thermally related growth to the extent experienced by chamber 30. Growth-related movement of the chamber 30 relative to the plenum 10 imparts to the tube 20 significant axial and flexural stresses and strains that may in turn rupture the plenum 10 and/or chamber 30.

Figure 2:
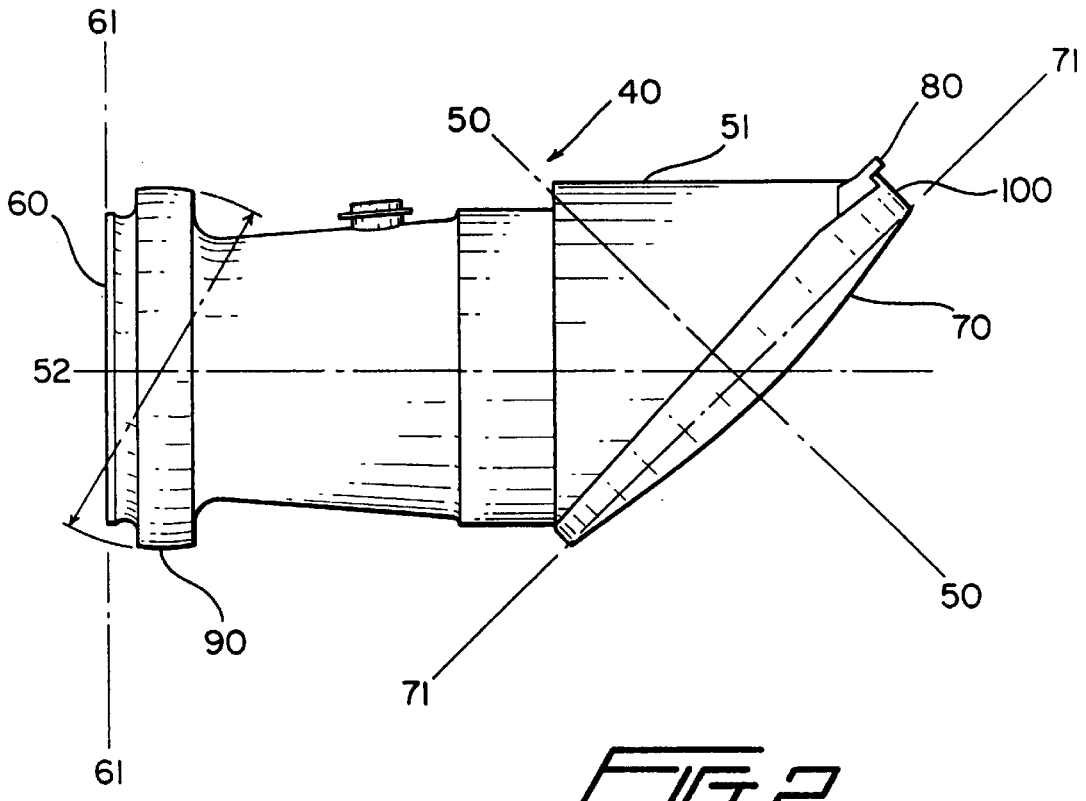
FIG. 2 is a side view of an injection tube incorporating features of the present invention.

FIG. 2 shows a hollow injection tube 40 incorporating features of one embodiment of the present invention. Tube 40 has an exterior surface 51 and an interior surface (not shown). Tube 40 includes a first mouth 60 and a second mouth 70, each of which are defined by a respective perimeter formed from and part of exterior surface 51 at each end of tube 40. First mouth 60, the entry plane 61 of which is vertically disposed, includes a longitudinal axis 52 and an outer surface 90 raised and rounded, about the entire perimeter of first mouth 60. Second mouth 70 includes a longitudinal axis 50 and an outer surface 100 having surface portions 100A and 100B. The contour of surface 100 may be ruled or curved, depending on the particular embodiment. The exit plane 71 of second mouth 70 is adapted to conform to the annular surface of a combustion chamber. Rocker tab 80 is formed upon exterior surface 51. The function of rocker tab 80 is described in further detail hereinafter.

Figure 3:
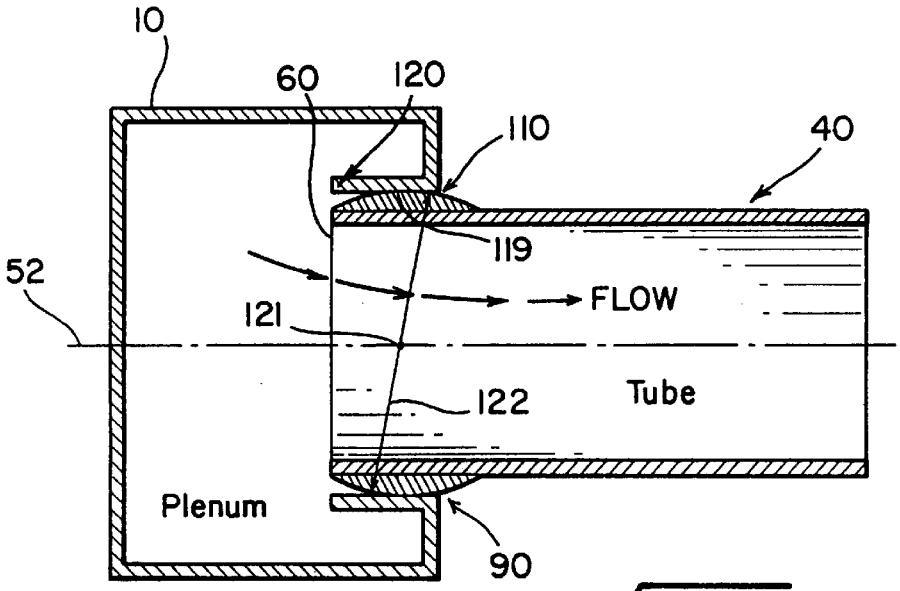
FIG. 3 is a cross-sectional view of the interface between an injection tube and a plenum incorporating features of the present invention.

FIG. 3 illustrates the connection between injection tube 40 and plenum 10 wherein first mouth 60 is shown inserted into plenum port 110 to create what is referred to herein as a spherical slip joint. Outer surface 90 is adapted to slidably engage the inner surface 119 of cylindrical sleeve 120 incorporated into the plenum port 110. To accommodate axial, flexural and torsional forces imparted to the tube 40, outer surface 90 is so engaged with cylindrical sleeve 120 as to allow free slip of the mouth 60 parallel to longitudinal mouth axis 52, rotation of the mouth 60 about any axis orthogonal to mouth axis 52 passing through the center of diameter 122 defined by surface 90, and rotation of the mouth 60 about longitudinal mouth axis 52.

Figure 4:
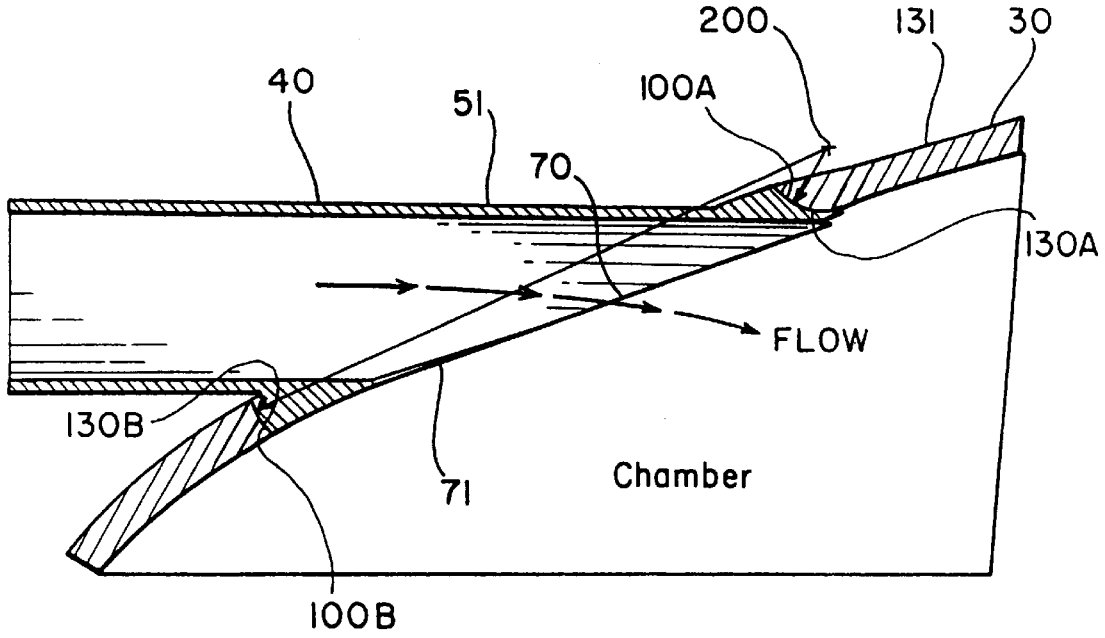
FIG. 4 is a cross-sectional view of the interface between an injection tube and an annular combustion chamber incorporating features of the present invention.

FIG. 4 illustrates the connection between injection tube 40 and a combustion chamber 30 wherein second mouth 70 is shown in fluid communication with chamber port 71. Outer second mouth surface portions 100A, 100B integral to tube exterior surface 51 are rotatably engaged with chamber port surface portions 130A, 130B which is formed from and part of chamber exterior surface 131. The engagement of surface portions 100A, 100B with chamber port surface portions 130A, 130B causes tube 40 to be freely rotatable about an axis 200 that is eccentric to second mouth 70. Surface portion 100A, which is closest to axis 200 is concave to engage a correspondingly convex surface portion 130A. Surface portion 100B, which is distal to axis 200 is convex to engage a correspondingly concave surface portion 130B. By forming surface portions 100B and 130A, 130B to have curved profiles, tube 40 can only be engaged to chamber 30 by first engaging upper surface portions 100A, 130A and rotating tube 40 downward about axis 200 until surface portions 100B and 130B engage. Once engaged, tube 40 is constrained to rotate about axis 200 as constrained by surface portions 100A, 100B, 130A, 130B while not disengaging from port 71. This form of coupling is hereinafter referred to as an eccentric spherical coupling.

Figure 5:
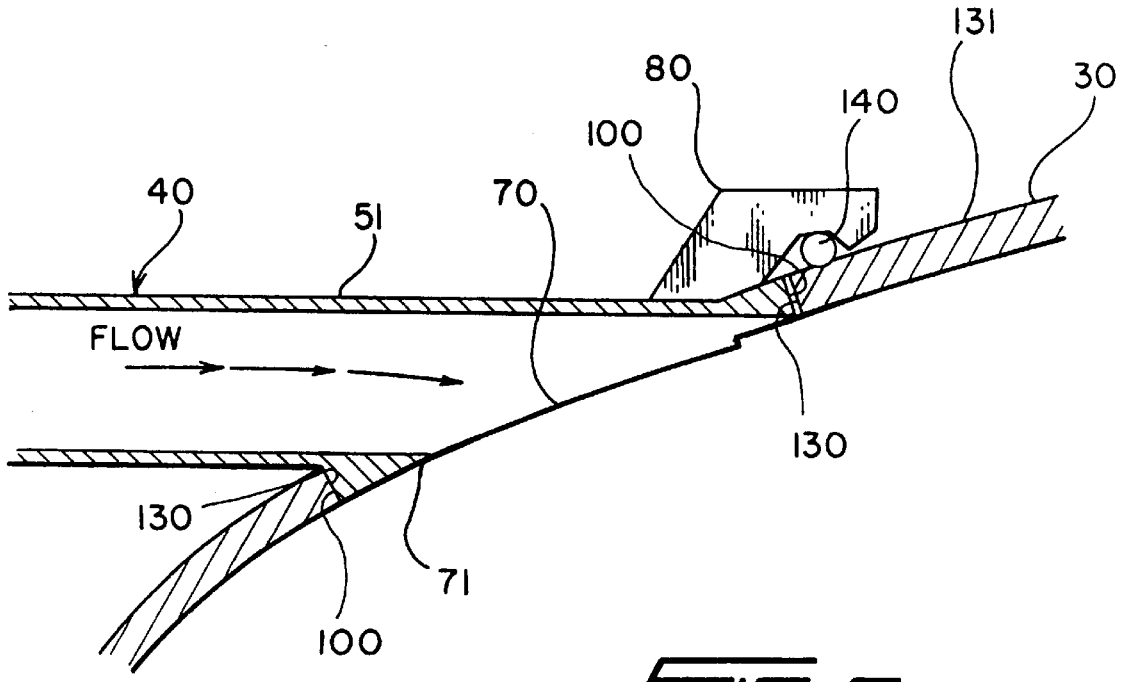
FIG. 5 is a cross-sectional view of an alternative embodiment of an interface between an injection tube and an annular combustion chamber.

FIG. 5 illustrates an alternative eccentric spherical coupling between injection tube 40 and a combustion chamber 30 wherein second mouth 70 is shown in fluid communication with chamber port 71. Outer second mouth ruled surface 100 is integral to tube exterior surface 51 and is slidably engaged with chamber port ruled surface 130 which is formed from and part of chamber exterior surface 131. Surfaces 100 and 130 do not completely constrain tube 40 axially. Accordingly, at least one rocker tab 80 is formed along the exterior surface 51 that may biasingly engage the chamber exterior surface 131 itself or, in the embodiment shown, engage a pivot tab 140 formed on the chamber exterior surface 131. Preferably, the engaging surfaces of rocker tab 80 and pivot tab 140 are curved, but may also be square, rectangular or otherwise geometrically configured. To accommodate flexural forces imparted to the tube 40, rocker tab 80 is so engaged by the pivot tab 140 as to prevent disengagement of the mouth 70 from the port surface 130. The engagement of pivot tab 140 by rocker tab 80 also allows rotation of mouth 70 about an axis normal to an axis defined by the radial force vector applied to the tube 40 by the chamber 30 somewhat independent of the constraints afforded by ruled surfaces at 100, 130. In any embodiment of the present invention, supplementary sealing means may be used as needed to reduce leakage at the interface of second mouth 70 and chamber port 71.

Although the invention has been described in terms of the illustrative embodiment, it will be appreciated by those skilled in the art that various changes and modifications may be made to the illustrative embodiment without departing from the spirit or scope of the invention. It is intended that the scope of the invention not be limited in any way to the illustrative embodiment shown and described but that the invention be limited only by the claims appended hereto.

What is claimed is:

1. A fluid injection apparatus for connecting a plenum having a plenum port to a chamber having a chamber port, the apparatus comprising:

a conduit having an exterior surface, a first mouth defined by a perimeter formed from said exterior surface and adapted for insertion into and fluid communication with the plenum port, and a second mouth defined by a perimeter formed from said exterior surface and adapted for operative connection and fluid communication with the chamber port;

said first mouth having a partially spherical surface adapted to engage the plenum port; and said second mouth is configured to engage the chamber port of the chamber to permit rotation about a transverse axis eccentric of said conduit.

2. The apparatus of claim 1, wherein:

said first mouth comprises a spherical slip coupling configured to allow free slip within the plenum port of said first mouth parallel to a longitudinal axis of said conduit, rotation within the plenum port of said first mouth in any plane perpendicular to the plenum port and rotation within the plenum port of said first mouth about said longitudinal axis.

3. The apparatus of claim 1 wherein said second mouth further comprises a rocker tab, said rocker tab being configured for biased engagement with a chamber exterior surface.

4. The apparatus of claim 1 wherein said second mouth comprises a concave surface proximal said transverse eccentric axis and a convex surface distal said transverse eccentric axis.

5. A fluid injection apparatus for connecting a plenum to a chamber comprising:

a hollow substantially cylindrical tube having an exterior surface defining a first mouth, said first mouth adapted for insertion into and fluid communication with the plenum, said exterior surface further defining a second mouth adapted for operative connection and fluid communication with the chamber;

said first mouth having a longitudinal axis and including an outer surface raised and rounded about an exterior surface of said first mouth and adapted for insertion into the plenum port, said outer surface configured to allow free slip within the plenum port of said first mouth parallel to said longitudinal axis, said outer surface configured to allow rotation within the plenum port of said first mouth in any plane perpendicular to the plenum port, said outer surface configured to allow rotation within the plenum port of said first mouth about said longitudinal axis; and a rocker tab disposed along said exterior surface proximal said second mouth, said rocker tab engaging the chamber exterior surface to prevent said second mouth from disengaging the chamber port.

6. An apparatus for receiving and combusting a fluid mixture formed in a plenum having a plenum port comprising:

a chamber having an exterior surface, at least one port formed from said exterior surface, and at least one first fastening element formed from said exterior surface;

at least one conduit having an exterior surface, a first mouth defined by a perimeter formed from said conduit exterior surface and adapted for insertion into and fluid communication with the plenum, and a second mouth defined by a perimeter formed from said conduit exterior surface and in fluid communication with said chamber port;

said first mouth having a longitudinal axis and including a second fastening element adapted for insertion into and multiple degrees of freedom within the plenum port; and a third fastening element formed from said conduit exterior surface, said third fastening element pivotally connected with said first fastening element thereby preventing disconnection of said second mouth from said chamber port.

7. The apparatus of claim 6 wherein said first fastening element comprises a pivot tab.

8. The apparatus of claim 6 wherein said first fastening element comprises a contoured chamber port surface.

9. The apparatus of claim 6 wherein:

said second fastening element is configured to allow free slip within the plenum port of said first mouth parallel to said longitudinal axis;

said second fastening element is configured to allow rotation within the plenum port of said first mouth in any plane perpendicular to the plenum port; and said second fastening element is configured to allow rotation within the plenum port of said first mouth about said longitudinal axis.

10. The apparatus of claim 9 wherein said second fastening element further comprises an outer surface of said first mouth, said first mouth outer surface being raised and rounded about the entirety of said first mouth perimeter.

11. The apparatus of claim 6 wherein said third fastening element comprises a rocker tab.

12. The apparatus of claim 6 wherein said third fastening element comprises a contoured second mouth outer surface.

13. An apparatus for receiving and combusting a fluid mixture formed in a plenum having a plenum port comprising:

an annular combustion chamber having an exterior surface, a port formed from said exterior surface, and a pivot tab formed from said exterior surface;

a hollow substantially cylindrical tube having an exterior surface, a first mouth defined by a perimeter formed from said cylindrical tube exterior surface and adapted for insertion into and fluid communication with the plenum, and a second mouth defined by a perimeter formed from said cylindrical tube exterior surface and in fluid communication with said chamber port;

said first mouth having a longitudinal axis and including an outer surface raised and rounded about the entirety of said first mouth perimeter and adapted for insertion into the plenum port, said outer surface configured to allow free slip within the plenum port of said first mouth parallel to said longitudinal axis, said outer surface configured to allow rotation within the plenum port of said first mouth in any plane perpendicular to the plenum port, said outer surface configured to allow rotation within the plenum port of said first mouth about said longitudinal axis; and a rocker tab disposed along said cylindrical tube exterior surface, said rocker tab pivotally connected with said pivot tab thereby preventing disconnection of said second mouth from said chamber port.

14. A method of receiving for combustion fluid formed in a plenum having a plenum port comprising the steps of:

forming a chamber having an exterior surface, a port formed from said exterior surface, and a first fastening element formed from said exterior surface;

forming a conduit having an exterior surface, a first mouth having a longitudinal axis and defined by a perimeter formed from said conduit exterior surface, and a second mouth defined by a perimeter formed from said conduit exterior surface;

forming a second fastening element from said first mouth, said second fastening element adapted for insertion into and multiple degrees of freedom within the plenum port;

forming a third fastening element from said conduit exterior surface, said third fastening element configured to engage said first fastening element thereby preventing disconnection of said second mouth from said chamber port;

inserting said first mouth into the plenum port; and placing said second mouth into fluid communication with said chamber port thereby engaging said third fastening element with said first fastening element.

15. A method in accordance with claim 14 wherein said first fastening element comprises a pivot tab.

16. A method in accordance with claim 14, wherein:

said second fastening element is configured to allow free slip within the plenum port of said first mouth parallel to said longitudinal axis;

said second fastening element is configured to allow rotation within the plenum port of said first mouth in any plane perpendicular to the plenum port; and said second fastening element is configured to allow rotation within the plenum port of said first mouth about said longitudinal axis.

17. A method in accordance with claim 16, wherein said second fastening element further comprises an outer surface of said first mouth, said first mouth outer surface being raised and rounded about the entirety of said first mouth perimeter.

18. A method in accordance with claim 14 wherein said third fastening element further comprises a rocker tab.

19. A method of receiving for combustion fluid formed in a plenum having a plenum port comprising the steps of:

forming an annular combustion chamber having an exterior surface, a port formed from said exterior surface, and a pivot tab formed along said exterior surface;

forming a hollow substantially cylindrical tube having an exterior surface, a first mouth having a longitudinal axis and defined by a perimeter formed from said cylindrical tube exterior surface, and a second mouth defined by a perimeter formed from said cylindrical tube exterior surface;

forming from said first mouth an outer surface raised and rounded about the entirety of said first mouth perimeter and adapted for insertion into the plenum port, said outer surface configured to allow free slip within the plenum port of said first mouth parallel to said longitudinal axis, said outer surface configured to allow rotation within the plenum port of said first mouth in any plane perpendicular to the plenum port, said outer surface configured to allow rotation within the plenum port of said first mouth about said longitudinal axis;

forming a rocker tab from said tube exterior surface, said rocker tab configured to engage said pivot tab thereby preventing disconnection of said second mouth from said chamber port;

inserting said first mouth into the plenum port; and placing said second mouth into fluid communication with said chamber port thereby engaging said rocker tab with said pivot tab.

* * * * *